United States Patent [19]

Stevens et al.

[11] 4,387,842

[45] Jun. 14, 1983

[54] BULK MATERIAL HANDLER AND FEEDER

[75] Inventors: Samuel B. Stevens, Pekin; James R. Lytle, Sr., Peoria, both of Ill.

[73] Assignee: Caterpillar Tractor Co., Peoria, Ill.

[21] Appl. No.: 245,552

[22] PCT Filed: Mar. 31, 1980

[86] PCT No.: PCT/US80/00350

§ 371 Date: Mar. 31, 1980

§ 102(e) Date: Mar. 31, 1980

[87] PCT Pub. No.: WO81/02879

PCT Pub. Date: Oct. 15, 1981

[51] Int. Cl.[3] ..... B65H 17/42; B65H 25/00

[52] U.S. Cl. ..... 226/113; 226/11

[58] Field of Search ..... 226/11, 34, 113, 115, 226/118, 123, 152, 158–164; 225/11, 46; 242/57, 75.52, 67.2; 318/6, 7; 93/8 R, 20

[56] References Cited

U.S. PATENT DOCUMENTS

| | | | |
|---|---|---|---|
| 2,147,467 | 2/1939 | Stephenson | 242/75.52 |
| 3,199,803 | 10/1965 | Mattson | 242/57 |
| 3,228,622 | 1/1966 | Colecchi | 242/67.2 |
| 3,721,376 | 3/1973 | Christian et al. | 226/113 |
| 4,070,951 | 1/1978 | Bala | 93/8 R |

*Primary Examiner*—Leonard D. Christian

*Attorney, Agent, or Firm*—Wegner, Stellman, McCord, Wood & Dalton

[57] ABSTRACT

A bulk material feeder (10) has two rollers (12,14), at least the lower (14) of which is driven (24,26). Strip material (34) is threaded around the side of the upper roller (12) toward the direction of feed, between the rollers (12,14), around the side of the lower roller (14) opposite the direction of feed and to downstream machinery (38) spaced from the feeder (10). Roller (12,14) spacing is greater than material (34) thickness precluding compression of the material (34). Feed is produced by friction between the roller (14) and material (34) only. Feed rate is greater than usage thereby producing a depending loop (40) between the feeder (10) and the downstream machinery (38). In one embodiment, increasing loop (40) size decreases material (34) and roller (14) contact, causing relative slippage and a discontinuance of feed. In another embodiment, both rollers (12,14) are driven and loop (40) size is limited by a photoelectric device (42) and associated control circuitry.

18 Claims, 3 Drawing Figures

BULK MATERIAL HANDLER AND FEEDER

DESCRIPTION

1. Technical Field

This invention relates to machines which positively and variably feed material from bulk storage to downstream processing machinery.

2. Background Art

Many machines or machine processes utilize bulk material in the form of strips wound in a coil or stored in a container as a starting point for operations which result in a finished product. Such machinery is commonly used in conjunction with an apparatus which feeds material from its storage configuration into the downstream machine or machines. This feed apparatus must be capable of positively feeding material to downstream machinery, adapting to variable material requirements, and should not unduly stress the material as it is being fed.

Existing feed apparatus usually includes at least one set of two rollers which rotate in opposite directions and compress the material to be fed therebetween in order to provide a positive drive. After exiting these rollers, the material falls into a loop before entering subsequent machinery. The feed rate is controlled by means of a so-called mechanical "dancer" which consists of two or more limit switches positioned to intercept the material loop. Operation of these limit switches provides signals which control the operation of a drive motor connected to the rollers. On-off operation of the drive motor results in a relatively constant loop size and variable material feed.

This type of machinery has not proven entirely satisfactory since the rollers induce undesirable compression forces in the material, may subject the material to tension between pairs of rollers, and may cause material breakage if the material is momentarily not free to feed from storage. Also, such machinery is often unduly large and cumbersome and is relatively unsafe in that an operator, or the like, can come into contact with the moving material and, since it is tacky, it can catch the clothing or parts of the operator and pull the clothing and/or the operator into the machine.

The present invention is directed to overcoming one or more of the problems as set forth above.

DISCLOSURE OF INVENTION

The present invention provides a bulk material feed apparatus which is extremely compact in size, and, after initial start up, automatically begins feeding material whenever such material is necessary for the operation of downstream machinery, is capable of feeding material at a variable rate, induces only small compression or tension stresses in the material, varies material feed without contacting the material after it exits the drive rollers, and discontinues material feeding and sounds an alarm when the end of the stock is reached.

More particularly, in one aspect of the invention, material is looped over a primary drive roller, threaded behind and around a secondary roller mounted below and separated from the primary roller, and directed substantially horizontal to subsequent processing machinery. The secondary roller rotates slightly faster than the primary drive roller and roller separation is such that there is a relatively small contact arc length between the secondary roller and the material. This reduced contact allows the secondary roller to slip relative to the material and thus maintain a small amount of tension on the material in order to provide positive contact between the material and the primary roller.

Material feed rate is slightly higher than that which is necessary for the proper operation of downstream components, thereby causing the bulk material to fall into a loop between the feed apparatus and the subsequent machinery. A photoelectric detector senses the size of the loop and controls material feed rate by alternately starting and stopping the primary and secondary rollers. In this manner, a variable feed rate is achieved without contact between the feed apparatus and the material other than the drive rollers themselves.

In another aspect of the invention, a single drive roller is utilized which automatically provides variable material feed and feed start-up without the necessity of providing loop-sensing devices or starting and stopping the drive roller motor. Variable feed is accomplished by providing limited contact between the material and the drive roller. A feed rate greater than downstream usage enlarges the loop of material between the feed apparatus and subsequent machinery which reduces contact between the drive roller and the material. At a certain reduction in contact area, the drive roller slips relative to the material thereby stopping further material feed. As the downstream machinery uses material and reduces the loop or arc between it and the feed apparatus, material wrap and contact with the drive roller is increased and positive drive automatically recommences.

In either configuration, a trip wire is provided below the lower roller which is utilized to stop the drive motor and provide an alarm signal. The trip wire is situated so as to intercept the end of the material as it falls from the feed apparatus and activates a switch to provide the stop and alarm functions.

BEST MODE FOR CARRYING OUT THE INVENTION

Figure 2:
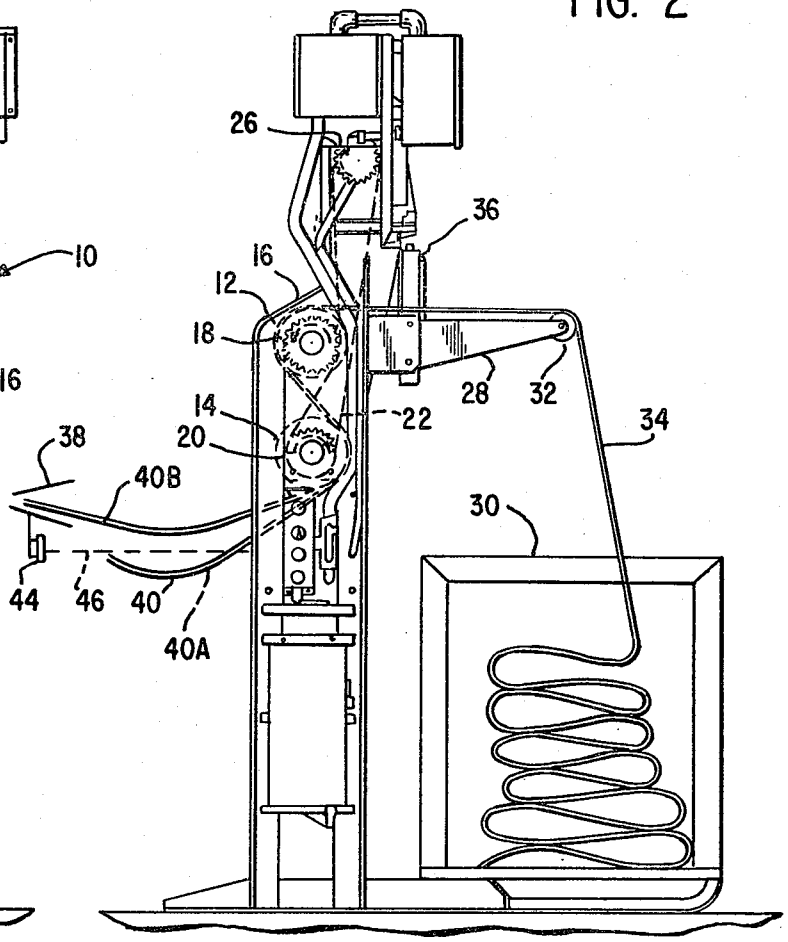
FIG. 2 is a side elevation of the embodiment of the invention shown in FIG. 1.
Figure 1:
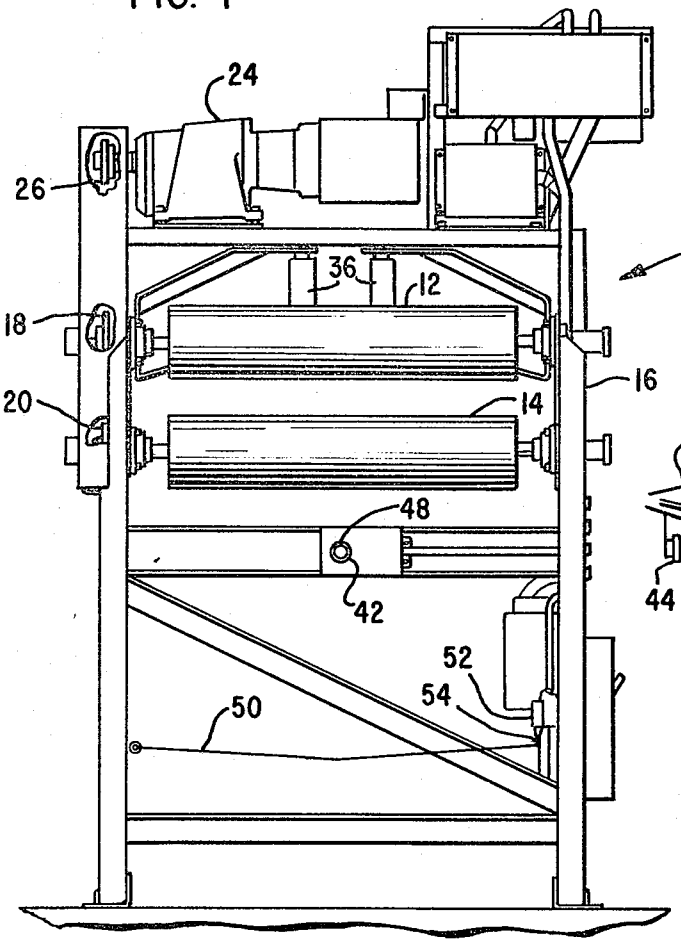
FIG. 1 is a front elevation of an embodiment of the present invention.

Referring to the drawings, and particularly FIGS. 1 and 2, a bulk material handler and feeder 10 is illustrated which includes a primary drive roller 12 and a secondary roller 14 mounted in a vertically spaced arrangement on a frame 16. The ends of the rollers 12 and 14 include sprockets 18 and 20 driven through a chain 22 by a motor 24 and drive sprocket 26. The chain 22 is so arranged around the sprockets 18 and 20 so as to drive the rollers 12 and 14 in opposite directions.

The frame 16 further includes an outwardly projecting arm 28 which projects over a storage container 30 and terminates in a guide roller 32.

Bulk material 34 in the form of a strip is fed over the roller 32, between upstanding centering rollers 36, and around the drive rollers 12 and 14. The material 34 is wrapped counterclockwise (as viewed in FIG. 2) partially around the primary roller 12, threaded between the two rollers 12 and 14, and is wrapped clockwise partially around the lower secondary roller 14.

The strip of material 34 is then fed to the entrance 38 of a subsequent processing machine (not shown) located downstream of the material feeder 10. Located within the downstream machine is means to draw the material 34 into the entrance 38 at a particular usage rate. Such means to draw the material 34 may be compression rollers gripping both sides of the material 34.

It is contemplated in this invention that the usage rate of the downstream machine be known, and that the speed of the motor 24 and tooth ratio between the drive sprocket 26 and the roller sprockets 18 and 20 be such that material 34 is fed from the material handler 10 at a greater rate than is used by the downstream machinery. In addition, the sprocket tooth ratio of the rollers 12 and 14 is such that the secondary roller 14 rotates at a higher speed than the primary roller 12.

The higher rotational speed of the secondary roller 14 causes the roller 14 to slip relative to the material 34, but because there is frictional drag between the material 34 and the roller 14, there will be a slight tension on the material located between the two rollers 12 and 14. This tension and the tension caused by the weight of material 34 remaining in the storage container 30 will ensure substantial contact between the material 34 and the primary roller 12 which, in turn, ensures that the material 34 will be fed at a rate equal to the surface velocity of the primary roller 12.

Since material 34 is fed by the bulk handler 10 at a rate faster than it is drawn into the entrance 38, a constant oversupply of material 34 results. This oversupply manifests itself as a hanging loop 40 between the handler 10 and the entrance 38. To prevent the material 34 from simply unwinding off the handler 10 due to the feed differential, a photoelectric device 42 is provided which is used in conjunction with a reflector 44 attached under the entrance 38. The photoelectric device 42 operates by emitting a beam of visible or infrared energy, depicted by the dotted line 46, which is directed toward the reflector 44 and reflected back to a sensor 48 located in the device 42. A suitable control circuit (not shown) is connected between the photoelectric device 42 and the motor 24 and operates to permit the motor 24 to run so long as the beam 46 is reflected and sensed by the sensor 48. If the beam 46 is blocked and prevented from returning to the sensor 48, the control circuit operates to shut off the motor 24.

In this fashion the size of the hanging loop 40 may be maintained at a relatively constant size. As shown in FIG. 2, as the loop 40 increases in size, it eventually hangs a distance sufficient to block the beam 46, as illustrated by double phantom lines 40A. As explained above, when the beam 46 is broken, the motor 24 will stop and material feed will be discontinued. As material 34 is drawn into the entrance 38, the loop 40 decreases in size until it reaches approximately the position shown by the solid lines 40B. At this point, the beam 46 is no longer blocked and the photoelectric device 42 and its associated control circuit will operate to again start the motor 24. A suitable time delay is incorporated into the control circuit to allow the loop 40 to vary over a relatively large range thus preventing continual on-off operation of the motor 24.

At any time that the demand for material into the entrance 38 is terminated, the loop will move or sag to the position shown by 40A which will interrupt the beam 46, will shut down the drive, and will stay in that position until a supply of material is again required. Therefore, as long as the material is continuous (i.e. not severed or terminated) there will be an automatic start up of operations when there is a demand for material. The feeder is capable of operating at optimum designed speed down to zero speed.

As the material 34 reaches the end of its length or if the strip of material 34 breaks, it is desirable that operating personnel be appraised of the situation so that the material 34 may be replaced and a relatively constant supply may be fed to the entrance 38. To provide such an alarm and to turn off the bulk handler 10, a trip wire 50 is provided which is connected to a limit switch 52. When the end of the material 34 passes the upper roller 12, the end will fall free between the two rollers 12 and 14 and fall toward the bottom of the frame 16. During its fall, the material 34 intercepts the trip wire 50 which pulls on a switch arm 54 and actuates the switch 52. Operation of the switch 52 provides an electrical signal to an appropriate control circuit which sounds an alarm and stops the motor 24.

Figure 3:
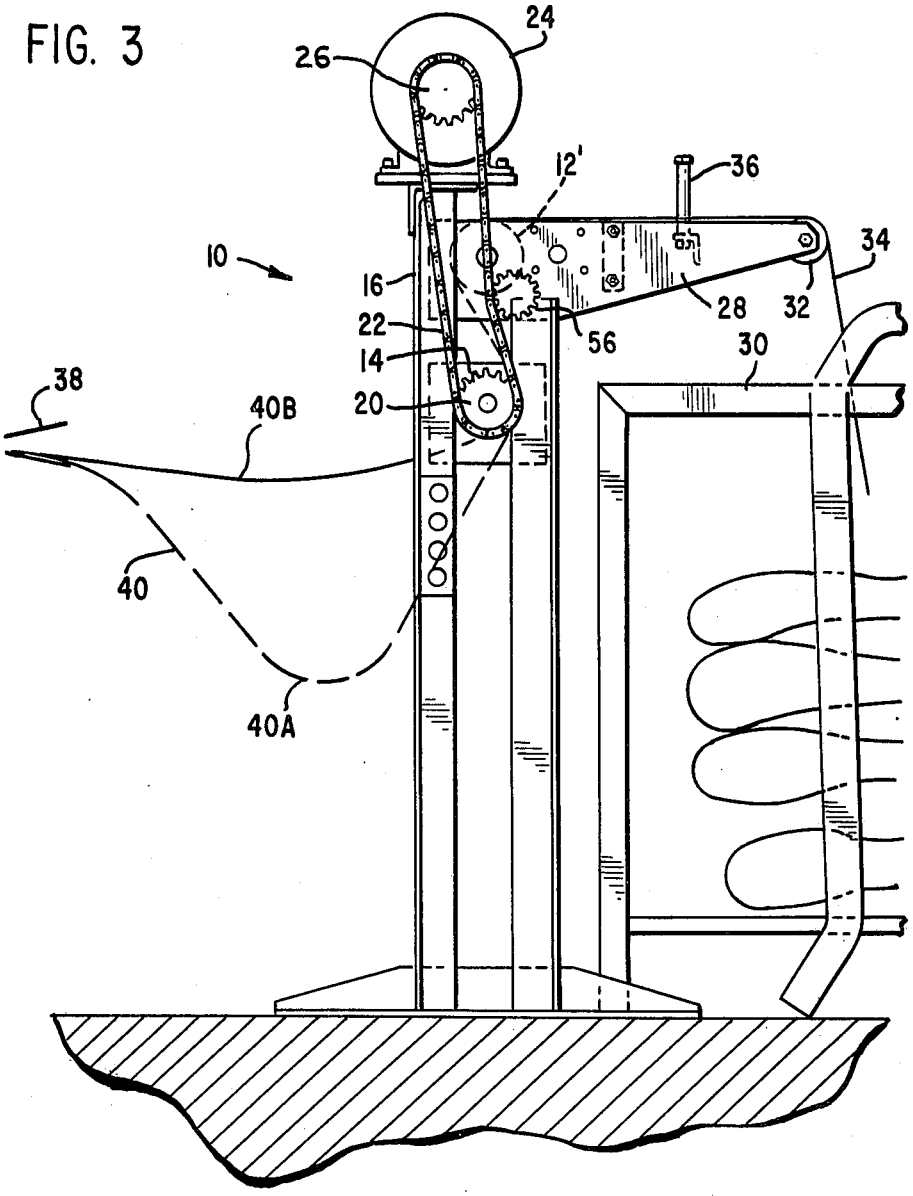
FIG. 3 is a side elevation of another embodiment of the present invention.

A similar bulk material handler 10 is illustrated in FIG. 3 which includes structure similar to that found in FIGS. 1 and 2 and labeled identically. The differences between the machine shown in FIG. 3 and that shown in FIGS. 1 and 2 are that the upper roller 12' is free running in FIG. 3, i.e. not driven by the motor 24 and chain 22, and that the photoelectric device 42 and reflector 44 are eliminated. The material handler 10 of FIG. 3 is further provided with a chain tensioning sprocket 56.

In the material handler 10 of FIG. 3, the material 34 is threaded as previously but material feed rate and the size of the hanging loop 40 is controlled by the lower roller 14 alone; the upper roller 12' being free rolling and merely a material support and guide. Control over material feed is accomplished by variation of the contact arc length between the lower roller 14 and the material 34. As in the machine of FIG. 1, the material is fed from the handler 10 at a rate greater than can be utilized by the downstream machine. Therefore, the size of the hanging loop 40 will tend to increase as discussed above. As the size of the loop 40 increases and approaches the configuration labeled 40A, angular contact between the material 34 and the roller 14 will decrease, thus decreasing the length of the material 34 in contact with the roller 14 and consequently decreasing the frictional force generated between the material 34 and the roller 14.

When the hanging loop 40 increases approximately to the representation labeled 40A, angular contact between the material 34 and the roller 14 will be so small that frictional forces between the material 34 and the roller 14 will not be sufficient to overcome the weight of material hanging from the guide roller 32. At this point, material feed will stop even though the drive roller 14 continues to rotate. The drive roller 14 will simply slip relative to the material 34. In addition to or rather than depending on the weight of material in the container 30 to provide resistance to material feed, the upper roller 12' may be provided with a frictional brake (not shown) to accomplish the same purpose.

As material is drawn into the entrance 38, the size of the hanging loop 40 will decrease and consequently, angular contact between the material 34 and the roller 14 will increase. At some point between the two extremes labeled 40A and 40B in FIG. 3, this angular contact will be such that sufficient friction is generated between the roller 14 and the material 34 to overcome the weight of material hanging from the guide roller 32 and its adhesion to layers under itself. At this point, positive material feed will recommence. The configuration of the material 34 between the handler 10 and the entrance 38 is shown by extreme conditions 40A and 40B, and it should be apparent that the hanging loop 40 will not actually vary between these two extremes. So long as material demand is constant, the hanging loop 40 will reach an equilibrium position at which slippage between the material 34 and the roller 34 is constant and the feed rate from the handler 10 is equal to material usage.

INDUSTRIAL APPLICABILITY

As will be appreciated from the drawings and foregoing description, a bulk material feed apparatus is provided which takes up little more space than the material storage container itself, and, once the drive is started, the apparatus automatically feeds material when such material is necessary for the operation of subsequent machinery, is capable of feeding material at a variable rate, and discontinues feeding material and sounds an alarm when either a break in the stock or the end of the stock is reached. In addition, the feed apparatus induces no compression forces in the material and except for a very small tension force necessary to maintain frictional contact between the driver rollers and the material, does not subject the material to tensile stresses.

Since the material feed apparatus depends for its operation on frictional engagement between the drive rollers and the material, it is contemplated that the drive rollers be constructed of a material which will effectively frictionally engage the type of material being fed. For example, if the bulk material is rubber or some other soft composition, the rollers may be made of metal or include a metal surface. However, in order to provide the desired frictional contact in the event metallic strips are to be fed, the rollers should be made of, or surfaced with, a softer composition such as rubber.

An inspection of FIGS. 2 and 3 will reveal that angular contact between the rollers and the material may be varied by changing the vertical and/or horizontal spacing between the upper and lower rollers. Such adjustments will provide optimal frictional engagement between the material to be fed and the drive rollers.

Other aspects, objects and advantages of this invention can be obtained from a study of the drawings, the disclosure, and the appended claims.

We claim:

1. A handler (10) for directing and feeding strip material (34) from a bulk supply to subsequent processing operations, a support (38) horizontally spaced from said handler (10), said handler comprising:

a frame (16);

upper and lower rollers (12,12',14) mounted on and vertically spaced along said frame (16) such that said rollers (12,12',14) are separated a distance greater than the thickness of said material (34);

means (22,24,20) for rotating at least the lower of said rollers (14); and guide means (28) spaced longitudinally from said upper roller (12,12') in a direction away from said support (38);

said strip material (34) being extended from the supply, over the guide means (28) and around the upper roller (12,12') in a direction toward said support (38), between said rollers (12,12',14), around said lower roller (14) in a direction away from said support (38), and to said support;

said strip material (34) and said lower roller (14) being frictionally engaged along an arc sufficient to maintain driving force on said material (34) as said material is fed toward said support (38);

said strip material (34) being freely suspended between said guide means (28) and said bulk supply along a length of said strip material (34), the weight of said length ensuring substantial contact between the material (34) and the upper roller (12,12'), as to ensure that the material (34) is advanced by the upper roller (12,12') at the velocity of the upper roller (12,12').

2. The handler of claim 1 further including means (18) to simultaneously rotate said upper roller (12).

3. The handler of claim 2 wherein said lower roller (14) is rotated faster than said upper roller (12).

4. A handler (10) for directing and feeding strip material (34) to subsequent processing operations, a support (38) horizontally spaced from said handler (10), said handler comprising:

a frame (16);

upper and lower rollers (12,12',14) mounted on and vertically spaced along said frame (16) such that said rollers (12,12',14) are separated a distance greater than the thickness of said material (34); and means (22,24,20) for rotating the lower of said rollers (14);

means (18) for rotating the upper roller (12) simultaneously with the lower roller (14), said lower roller (14) rotated faster than the upper rollers (12);

said strip material (34) being around the upper roller (12,12') in a direction toward said support (38), between said rollers (12,12',14), around said lower roller (14) in a direction away from said support (38), and to said support;

said strip material (34) and said lower roller (14) being frictionally engaged along an arc sufficient to maintain driving force on said material (34) as said material is fed toward said support (38);

said material (34) being driven toward said support (38) at a higher rate than said material is removed from said support by said subsequent processing operations thereby producing a depending loop (40) of material (34) between said lower roller (14) and said support (38).

5. The handler of claim 4 further including means (42,44,48) for detecting when said loop (40) depends a predetermined distance and means for discontinuing material feed when said loop (40) has depended said predetermined distance.

6. The handler of claim 5 wherein said detection means (42,44,48) includes a photoelectric device (42) located below the level of said support (38) responsive to an energy beam (46) directed along the path of said strip (34) from a point below the level of said support (38), said device (42) including means for stopping rotation of said rollers (12,14) when said beam (46) is prevented by said loop (40) from reaching said device (42).

7. A handler (10) for directing and feeding strip material (34) to subsequent processing operations, a support (38) horizontally spaced from said handler (10), said handler comprising:

a frame (16);

upper and lower rollers (12,12',14) mounted on and vertically spaced along said frame (16) such that said rollers (12,12',14) are separated a distance greater than the thickness of said material (34); and means (22,24,20) for rotating at least the lower of said rollers (14);

said strip material (34) being around the upper roller (12,12') in a direction toward said support (38), between said rollers (12,12',14), around said lower roller (14) in a direction away from said support (38), and to said support;

said strip material (34) and said lower roller (14) being frictionally engaged along an arc sufficient to maintain driving force on said material (34) as said material is fed toward said support (38);

said material (34) being driven toward said support (38) at a higher rate than said material is removed from said support (38) by said subsequent processing operations thereby producing a depending loop (40) of material (34) between said lower roller (14) and said support (38).

8. The handler of claim 7 further including means for reducing said frictional engagement and discontinuing material feed when said loop (40) depends a predetermined distance.

9. The handler of claim 8 wherein said means for reducing engagement includes maintaining said loop (40) free in a hanging state between said lower roller (14) and said support (38) whereby increasing dependency and size of said loop (40) reduces the arc of contact between said material (34) and said lower roller (14) thereby reducing said frictional engagement to a point where slippage between said lower roller (14) and said material results in stopping the feed of material by said lower roller (14).

10. The handler of claim 1 wherein said guide means (28) comprise an outwardly projecting arm (28) extending from said frame (16) for receiving said material (34) from the bulk supply and directing said material (34) to said upper roller (12,12').

11. A handler (10) for directing and feeding strip material (34) to subsequent processing operations, a support (38) horizontally spaced from said handler (10), said handler comprising:

a frame (16);

upper and lower rollers (12,12',14) mounted on and vertically spaced along said frame (16) such that said rollers (12,12',14) are separated a distance greater than the thickness of said material (34);

means (22,24,20) for rotating at least the lower of said rollers (14); and means (50) for detecting either a break in the strip of material (34) or the end of the strip of material (34), said means (50) stopping the rotation of the lower roller (14) when tripped by said break or by said end;

said strip material (34) being around the upper roller (12,12') in a direction toward said support (38), between said rollers (12,12',14), around said lower roller (14) in a direction away from said support (38), and to said support;

said strip material (34) and said lower roller (14) being frictionally engaged along an arc sufficient to maintain driving force on said material (34) as said material is fed toward said support (38).

12. A handler (10) for directing and feeding strip material (34) to subsequent processing operations, a support (38) horizontally spaced from said handler (10), said handler comprising:

a frame (16);

upper and lower rollers (12,12',14) mounted on and vertically spaced along said frame (16) such that said rollers (12,12',14) are separated a distance greater than the thickness of said material (34);

means (22,24,20) for rotating at least the lower of said rollers (14); and means (24) for activating said rotating means for feeding said material (34) toward said support (38), and means (42) for deactivating said activating means (24) when the demand for material has ceased;

said strip material (34) being around the upper roller (12,12') in a direction toward said support (38), between said rollers (12,12',14), around said lower roller (14) in a direction away from said support (38), and to said support;

said strip material (34) and said lower roller (14) being frictionally engaged along an arc sufficient to maintain driving force on said material (34) as said material is fed toward said support (38).

13. The handler of claim 12 wherein said deactivating means (42) includes a photoelectric device (42) for detecting when the material (34) between the lower roller (14) and the support (38) sags a predetermined amount, which sag will trigger the photoelectric device (42) to shut off the activating means (24).

14. A handler (10) for directing and feeding strip material (34) to subsequent processing operations, a support (38) horizontally spaced from said handler (10), said handler comprising:

a frame (16);

upper and lower rollers (12,14) mounted on and vertically spaced along said frame (16) such that said rollers (12,14) are separated a distance greater than the thickness of said material (34); and means (22,24,20) for rotating said rollers (12, 14) in opposite directions with said lower roller (14) being driven at a speed slightly in excess of the speed of rotation of the upper roller (12);

said support (38) being aligned with said lower roller (14);

said strip material (34) extending around the upper roller (12) in a direction toward said support (38), between said rollers, around said lower roller (14) in a direction first away from and then toward said support (38);

said strip material (34) frictionally engaging said rollers (12,14) and being fed by said frictional engagement toward said support (38).

15. A handler (10) for directing and feeding strip material (34) to subsequent processing operations, a support (38) horizontally spaced from said handler (10), said handler comprising:

a frame (16);

upper and lower rollers (12,12',14) mounted on and vertically spaced along said frame (16) such that said rollers (12,14) are separated a distance greater than the thickness of said material (34); and means (22,24,20) for rotating said rollers (12,14) in opposite directions with said lower roller (14) being driven at a speed slightly in excess of the speed of rotation of the upper roller (12);

said support (38) being aligned with said lower roller (14);

said strip material (34) being around the upper roller (12,) in a direction toward said support (38), between said rollers, around said lower roller (14) in a direction first away from and then toward said support (38);

said strip material (34) frictionally engaging said rollers (12,14) and being fed by said frictional engagement toward said support (38);

said material (34) being driven toward said support (38) at a higher rate than said material is removed from said support (38) by said subsequent processing operations thereby producing a depending loop (40) of material (34) between said lower roller (14) and said support (38).

16. The handler of claim 14 further including means (42,44,48) for detecting when said loop (40) depends a predetermined distance for shutting off further feed of said material (34) from said rollers (12,14).

17. A handler (10) for directing and feeding strip material (34) to a horizontally spaced support (38) for subsequent processing operations, comprising:

a frame (16);

upper and lower rollers (12',14) mounted on and vertically spaced apart along said frame (16) such that said rollers (12',14) are separated a distance greater than the thickness of said material (34), said upper roller (12') being freely rotatable on said frame (16); and means (22,24,20) for rotatably driving said lower roller (14);

said support (38) being substantially in alignment with said lower roller (14);

said strip material (34) being threaded around the upper roller (12') in a direction toward said support (38), between said rollers (12',14) and around said lower roller (14) in a direction first away from said support (38) and then toward said support (38);

said lower roller (14) frictionally engaging said strip material (34) for advancing said strip material (34) from a storage compartment (30) to said support (38);

said speed of rotation of said lower roller (14) frictionally advancing said strip of material (34) at a rate faster than said processing operation on said support (38) can handle said material (34) whereby a loop (40) of material is formed between said lower roller (14) and said support (38).

18. The handler of claim 17 wherein said frictional engagement between said lower roller (14) and said material (34) is reduced to a non-driving engagement when said loop (40) depends a predetermined distance for a line between said support (38) and said lower roller (14).

* * * * *